United States Patent [19]

Paige

[11] Patent Number: 4,892,445

[45] Date of Patent: Jan. 9, 1990

[54] MAN PORTABLE SHALLOW WATER STRUCTURE

[75] Inventor: Marshall A. Paige, Pass Christian, Miss.

[73] Assignee: The United States of America as represented by the Secretary of the Navy, Washington, D.C.

[21] Appl. No.: 54,354

[22] Filed: Apr. 29, 1987

[51] Int. Cl.[4] ..... E02D 5/74

[52] U.S. Cl. ..... 405/224; 405/195

[58] Field of Search ..... 405/195, 224, 226, 228, 405/231

[56] References Cited

U.S. PATENT DOCUMENTS

| | | | |
|---|---|---|---|
| 2,897,654 | 8/1959 | Harris | 405/226 X |
| 2,988,893 | 6/1961 | Borrmann et al. | 405/226 |
| 3,289,421 | 12/1966 | Hindman | 405/228 |
| 4,491,439 | 1/1985 | Watkins | 405/224 |
| 4,618,288 | 10/1986 | Daigle | 405/228 X |

*Primary Examiner*—Dennis L. Taylor

*Attorney, Agent, or Firm*—Thomas M. Phillips; Thomas E. McDonald

[57] ABSTRACT

A man portable (80 lbs) surface piercing structure which can be installed in shallow water (nominally 10 ft) from a small boat without divers assistance. The structure is comprised of two separate assemblies, a mast and a foundation. The mast is joined to its foundation by a mechanical latch and release mechanism which is internal to the mast.

7 Claims, 7 Drawing Sheets

MAN PORTABLE SHALLOW WATER STRUCTURE

BACKGROUND OF THE INVENTION

1. Field of the invention

The present invention relates to support structure and more particularly to method and apparatus for installing support structures for tide measurement and telemetry system, in shallow coastal waters.

2. Description of the Prior Art

Prior known methods of installing telemetering tide gauges include mounting the measurement instrumentation and telemetry antenna on an existing structure such as a dock or lighthouse. The disadvantage of this type of installation is that a telemetering tide gauge could only be installed at sites where a suitable structure already existed and approval for the installation could be obtained from the property owner. An alternative approach would entail constructing a structure at the desired location which is a costly and labor intensive chore with similar approval problems. Another method utilized is a bottom moored surface buoy to support the telemetry antenna. The disadvantage of this method include: susceptibility to loss or damage caused by wind, waves and current, theft, vandalism, or boat collision; susceptibility to vertical reference shift of the measurement sensor due to various loads (environmental, human) on the anchor; inability to remove and replace the tide gauge equipment without loss of the established tide datum; and inability to survey from shore in order to install a tidal benchmark. U.S. Pat. No. 3,636,718 is cited as being representative of the art of installing elongated uprights in the sea bottom.

SUMMARY OF THE INVENTION

A device constructed in accordance with the present invention includes a man portable surface piercing structure which can be installed in shallow water (nominally 10 ft.) from a small boat without diver assistance. The structure is comprised of two separate assemblies, a mast and a foundation.

The mast is joined to its foundation by a mechanical release mechanism which is internal to the mast and has a flexible joint at its foundation just above the release mechanism to protect the mast from breakage due to external forces. Means are provided in the mast for housing the electronics package.

The foundation used depends on the ocean bottom type. A long piling is water jetted into the soil bottom while a short drill shaft is grouted into coral, for example.

Accordingly an object of the invention is the provision of a man-portable yet highly stable platform which can be easily installed in shallow costal waters from a small boat without diver support.

Another object of the invention is the provision of a man-portable yet highly stable platform which can be easily installed in shallow costal waters from a small boat without diver support for mounting tide measurement and telemetry equipment in a secure and high survivability manner.

Other objects, advantages and novel features of the invention will become apparent from the following detailed description of the invention when considered in conjunction with the accompanying drawings.

BRIEF DESCRIPTION ON THE DRAWING

FIG. 1 is a schematic showing of an embodiment of the invention where the foundation is embedded in a soil or the like.

FIG. 4 is a schematic showing of an embodiment of the invention where the foundation is embedded in coral or the like.

DESCRIPTION OF THE PREFERRED EMBODIMENTS

In describing the invention, the mast structure is the same in both embodiments and the same reference numbers will be used throughout the description to refer to the same structure.

Figure 1:
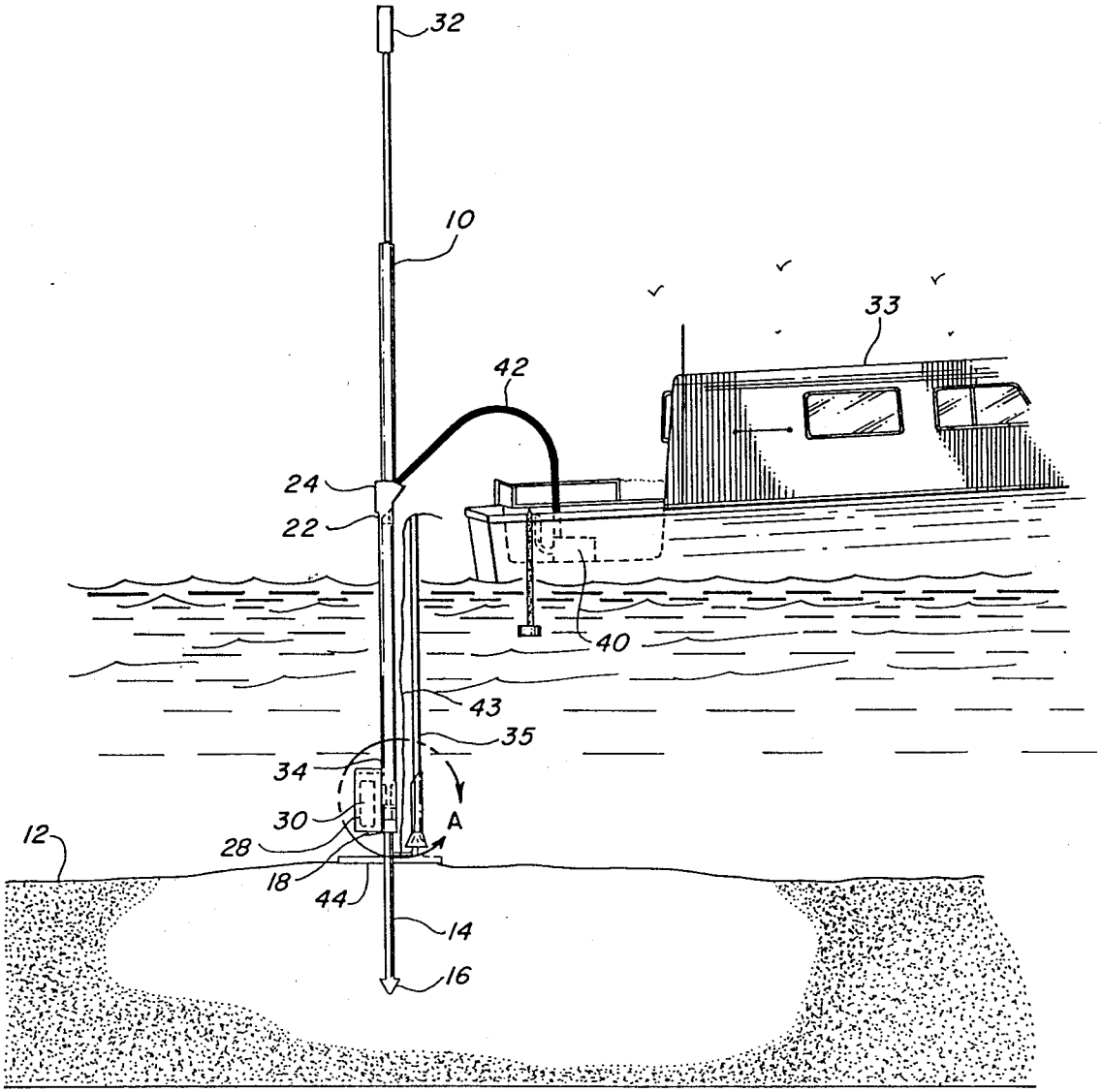
Figure 2:
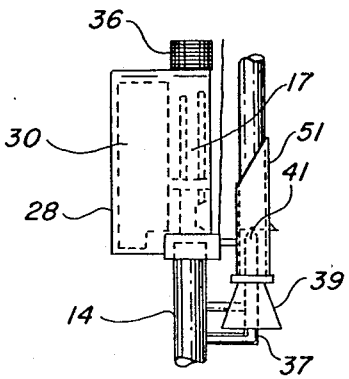
FIG. 2 and 3 show the detail of the latching of the mast to the foundation of the embodiment of FIG. 1.
Figure 5:
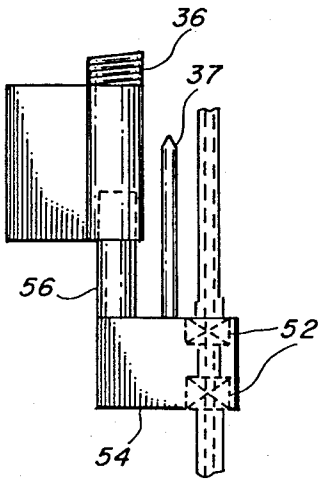
FIG. 5 shows the detail of the latching of the mast to the foundation of the embodiment of FIG. 4.
Figure 8:
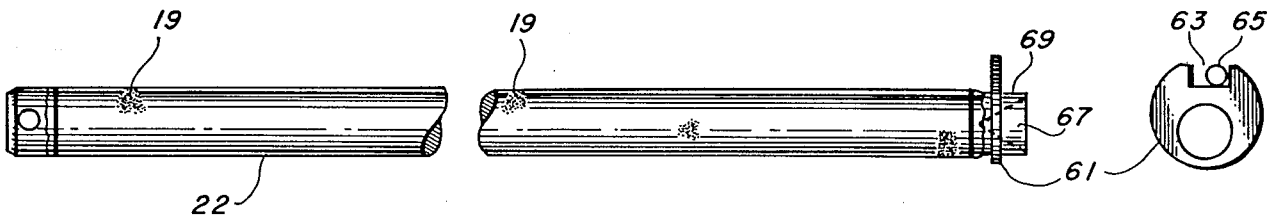
FIG. 8 shows the weighted and keyed messenger used in FIG. 3.

Referring now to the drawings wherein there is shown in FIG. 1 the mast 10 which is attached to a foundation that is anchored in the soil 12 by means of a piling 14. At the lower end of piling 14 is an anchor cone 16 shown and described in my copending application Ser. No. 07/046,344 filed Apr. 29, 1987, now U.S. Pat. No. 4,773,793. Attachment of mast 10 to piling 14 is made by means of a latching socket 18 as shown in FIG. 2 and the latching socket 18 is located at the bottom of mast 10. A latch and release mechanism 17 internal to the latching socket 18 includes a latch member 21 which is connected to a release lever 20 by a threaded bolt 25. The upper end of the latch member 21 is affixed to the latching socket 18. The lower end of the latch member 21 includes a portion 26 which extends into a hole 23 of the piling 14 and locks the mast 10 to the piling 14. The release lever 20 has a lower end section 27 which extends horizontally to the latching socket 18. This end section 27 is offset from the latch member 21 so that it does not interfere with movement of the latch member 21. The release lever 20 is used when it is desired to remove the mast 10 from the foundation and is activated by a weighted and keyed release messenger 22 (FIG. 8) which is inserted into a lateral fitting 24 and which rides down the inside of mast 10. Messenger 22 has a guide plate 61 containing a slot 63 keyed to the electric cable 65 to insure that conical, cavity 67 of head 69 will engage the conical upper end of release lever 20. This causes release lever 20 to move away from the pipe wall 71 pulling latch member 21 with it to disengage latch member 21 from piling 14 or pipe 56 (FIG. 5). The lateral fitting 24 should be positioned within mast 10 so that it is accessible from a small boat at low tide. Messenger 22 is made of flexible material and should be long enough to contain sufficient lead shot 19 to provide the required weight to unlatch mast 10.

A free flooding lower instrument housing 28 is attached by means of welding or the like to latching socket 18 and is used to enclose and protect an electronics pressure vessel 30. To open the lower instrument housing 28 requires access to the inside of latching socket 18 which can only be achieved after release of the mast 10 from the piling 14. Placing the instrument in a tamper proof underwater enclosure maximizes security. An upper instrument housing 32 which may be made of fiberglass is attached to the top of mast 10 and is used to enclose and protect the required above surface electronics such as antenna and various environmental sensors (not shown). Electrical cabling between the upper instrument housing 32 and lower instrument housing 28 are totally contained within mast 10 and are protected from the environment and vandalism.

Figure 9:
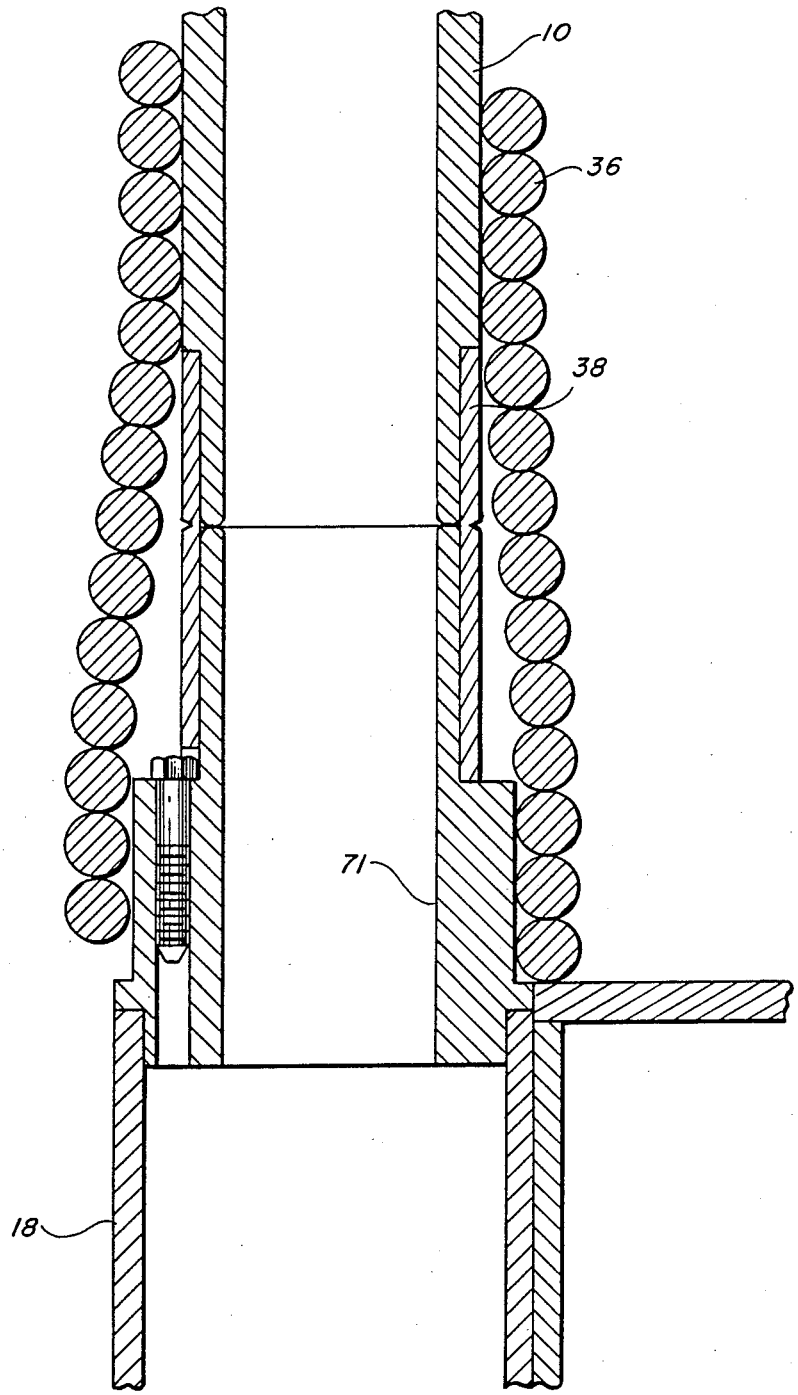
FIG. 9 shows the detail of the breakaway flexible joint of FIGS. 2 and 5.

A flexible joint 34 includes a helical closed coil spring 36 which attaches the bottom of the mast 10 to the top of latching socket 18 (FIG. 9). Flexible joint 34 contains a breakaway section of pipe 38 internal to the spring 36 which stiffens the mast structure up to a pre-selected load before fracturing circumferentially to protect the mast 10 from overload.

Flexible joint 34 then permits mast 10 to bend under excessive horizontal loads caused by waves or boat impact increasing survivability.

Figure 6:
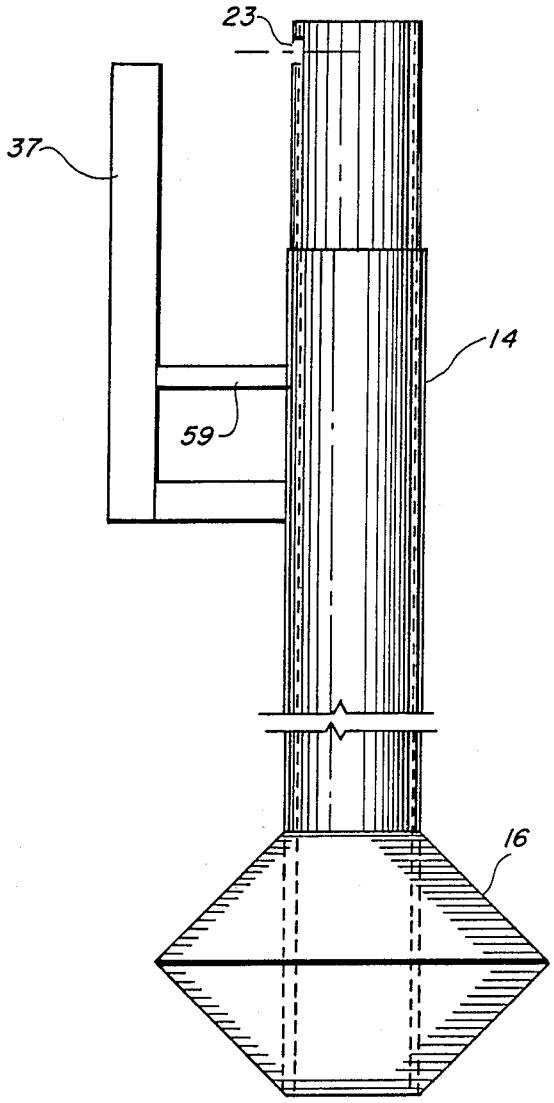
FIG. 6 shows the foundation for the mast of FIG. 1.

The foundation for the mast consists of a piling 14 with an anchor cone 16 welded to the bottom as shown FIG. 6. The upper end of the piling 14 slides into the latching socket 18 of the mast 10 and is held in position by the engagement of the latch member 21 with the hole 23 in piling 14. A water pump 40 is attached to lateral fitting 24 by means of water hose 42 and water is pumped through mast 10, flexible joint 36, piling 14 and out the bottom of anchor cone 16. The foundation is jetted into the soil to a depth determined by the position of stop rod 44. Vertical rigidity of the soil foundation is achieved via the anchor cone 16 in the manner described in the above referenced copending application.

Figure 3:
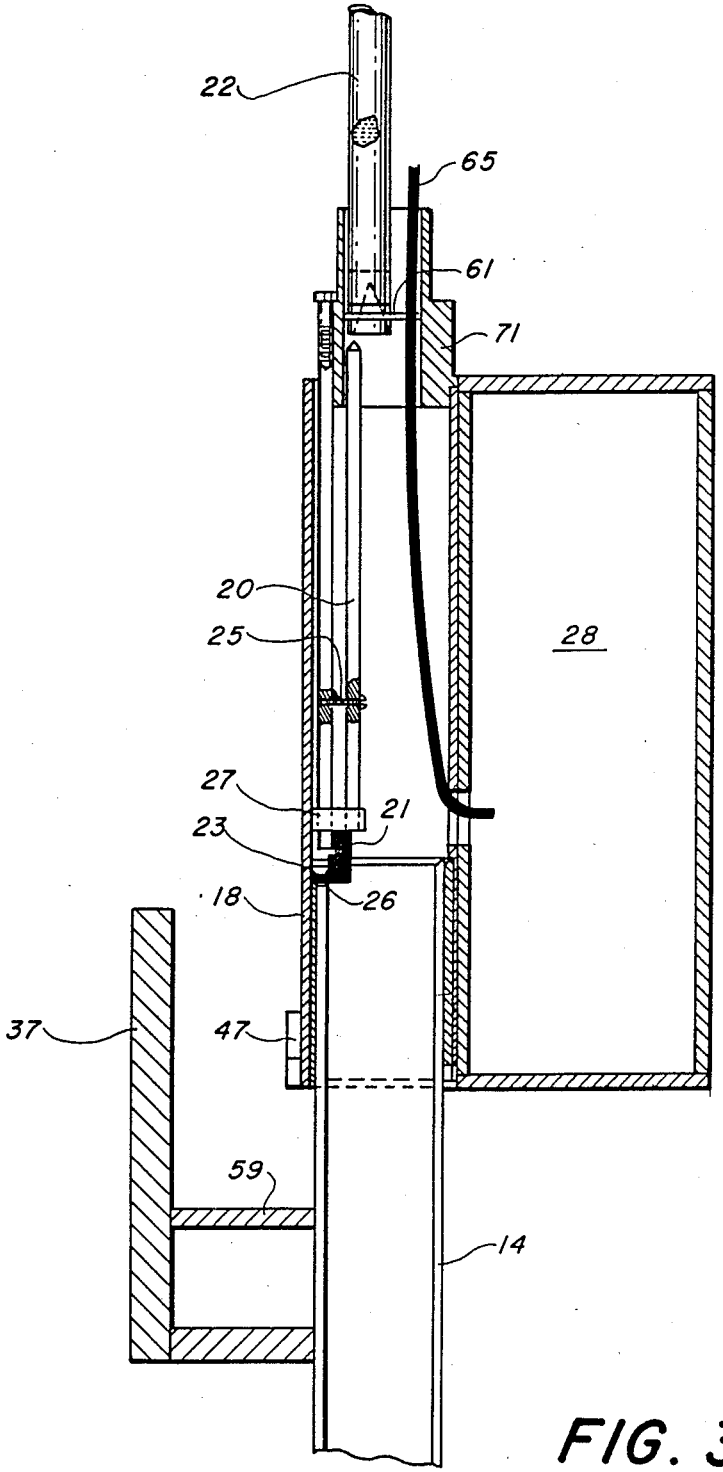
Figure 4:
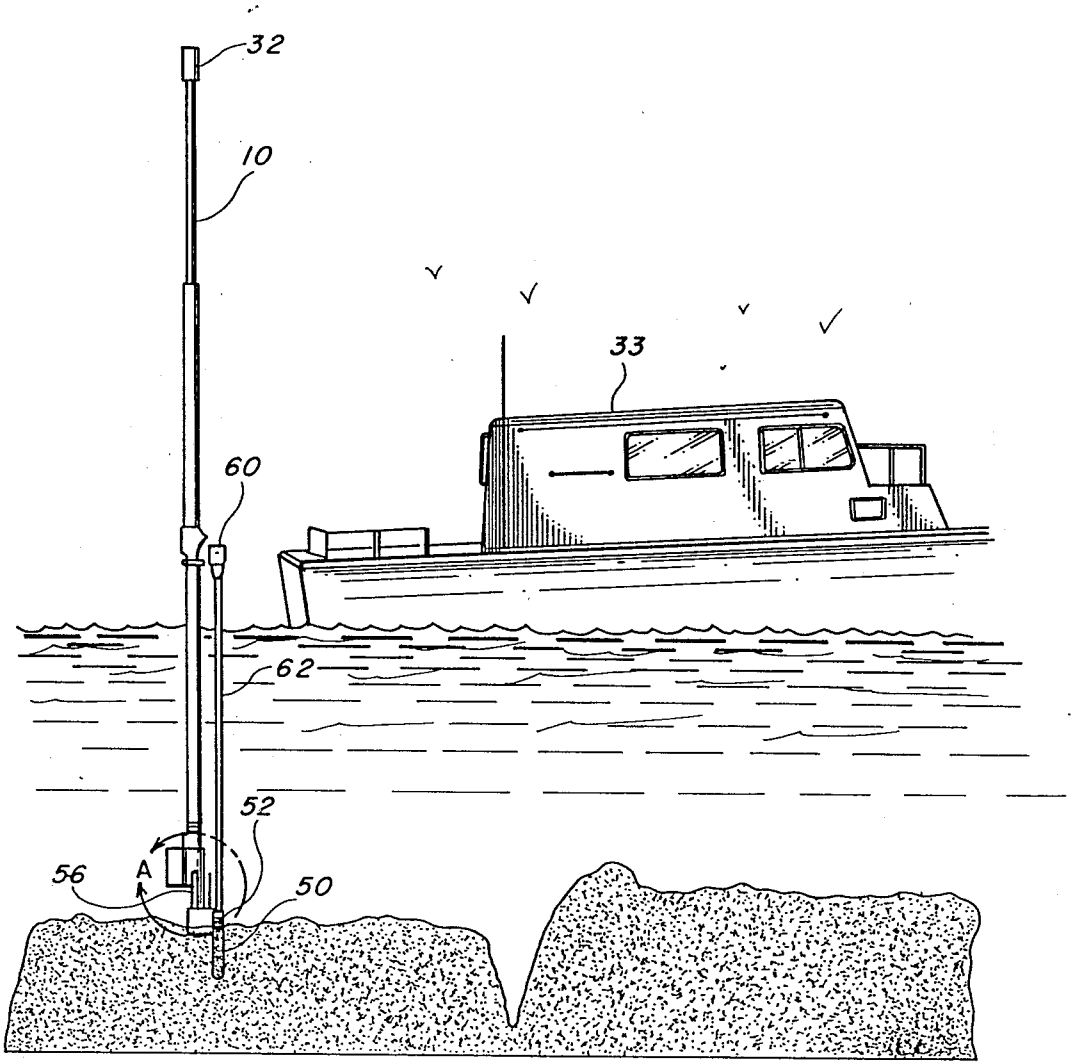

In the embodiment of FIG. 4, the foundation consists of a hollow drill bit 50 which is drilled into the coral and secured in place by adhesive. The drill bit 50 rotates in bearings 52 attached to a bracket 54 (FIG. 5). An attaching pipe 56 is welded to bracket 54 on an axis parallel to the drill bit 50 rotational axis. Mast 10 locks onto the latching pipe 56 in the same manner as described above in the description of FIGS. 2 and 3. A surface drill motor 60 is connected to the drill bit 50 by hollow shaft 62. After drill bit 50 has reached the proper depth, the drill motor 60 is removed from the hollow shaft 62. Adhesive is injected down the hollow shaft 62 through the hollow drill bit 50 and into the space between the drill bit 50 and the coral. After the adhesive injection hollow shaft is removed. Upon adhesive cure, the foundation is permanently attached to the ocean bottom.

Removal of the mast 10 and reinstallation onto the foundation of either FIG. 1 or FIG. 4 is accomplished from a small boat anchored securely alongside or stern to the structure. To overcome visibility limitations and to control wave inducted motions in the mast 10 and boat 33, the alignment of the latching socket 18 with the foundation is facilitated by temporarily attaching a guide pole 35 (FIG. 1, 2 and 7) onto the foundation.

Guide pole 35, a long section of pipe, is lowered vertically to the foundation using mast 10 as a position reference engages stinger 37 which is affixed to piling 14 in FIG. 1 and to pipe 56 in FIG. 4 adjacent to and a precise distance from the structure to which it is attached. A capture cone 39 on the bottom end of guide pole 35 facilitates location of the stinger 37, by increasing the apparent diameter of the guide pole 35. As the base of the capture cone 39 engages the stinger 37, the guide pole 35 will slide over stinger 37 into the required position. With guide pole 35 in position, mast 10 may be removed.

To prevent inadvertent vertical movement of guide pole 35, slot 57 engages upper bracket 59 attaching stringer 37 to piling 14. This is done prior to inserting slide 41.

Figure 7:
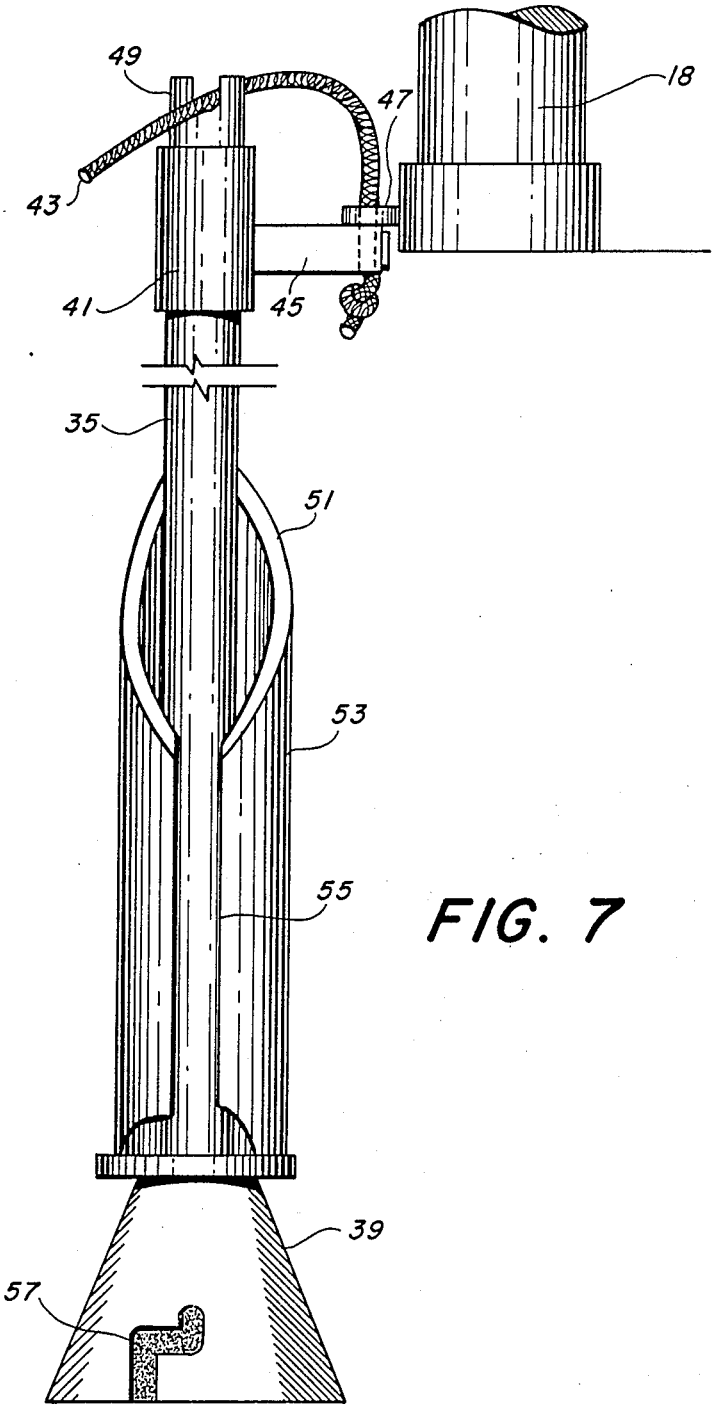
FIG. 7 shows an illustration showing the re-installing of the mast and the detail of the guide pole assembly.

To re-install mast 10, a slide 41 is placed over the top end of guide pole 35. A rope 43 attached to guide member 45 of slide 41 is run through an eye 47 at the side of the latching socket 18 and then to a slot 49 cut in the top of guide pole 35. When mast 10 is lowered over the side of the boat 33, the weight of mast 10 is borne by guide pole 35 thereby decoupling mast 10 from the boat motion. As shown in FIG. 7 paying out the rope 43 lowers mast 10 down the guide pole 35 until guide member 45 engages the inclined surface 51 of orienting pipe 53 and will rotate until guide member 45 drops into slot 55 of orienting pipes 53. Since mast 10 is attached to guide member 45 via rope 43, it will rotate and properly align to slide over piling 14 or pipe 56. Further payout of rope 43 lowers mast 10 until latch member 21 locks mast 10 to the foundation. Guide pole 35 is then removed from the foundation which in turn retrieves rope 43 and slide 41.

In operation, the system is loaded aboard boat 33 in two pieces, the structure and the foundation. At low tide the boat 33 proceeds to the desired location and positions itself via a three-point moor in 2 to 3 meters of water. The crew of the boat 33 attaches the appropriate foundation to the structure. If the structure is to be installed in soil, the water-jetting hose is attached to the structure. If the structure is to be installed in coral, the drive motor and drill shaft are attached to the structure. The entire assembly is hoisted by a davit located on the boat stern. The assembly is swung over the side and rotated into a vertical position. The structure is disconnected from the davit during the installation and guided by a crewman standing on a diving platform mounted on the boat transom. The structure is maintained in a vertical orientation during the jetting or drilling by watching a bubble level attached to the structure. When the anchor piling reaches approximately a 5-ft depth for soil or an 18-in depth in coral, the pump or motor is shut down and disconnected from the structure. In coral, grout is pumped down the hollow drill shaft to anchor the foundation in place.

To retrieve the structure, boat 33 is again anchored via a three-point moor. The structure can be detached from its foundation by inserting the keyed release messenger 22 into the pump inlet fitting and lowering it down the section of pipe to actuate the release lever 20. The structure and electronics can then be hoisted onboard and replaced with a refurbished unit. Because the foundation is fixed, change out of the tide gauge structure will not shift the vertical location of the pressure sensor. Thus, the vertical reference of the tide gauge will remain constant.

Obviously many modifications and variations of the present invention are possible in light of the above teachings. It is therefore to be understood that within the scope of the appended claims the invention may be practiced otherwise than as specifically described.

What is claimed:

1. A man portable surface piercing tide measurement system support structure that is highly stable and can easily be installed in shallow coastal waters from a small boat without diver intervention, the combination comprising:

a foundation to be installed in the ocean bottom;

a separable mast coupled to said foundation;

each of said mast and said foundation being man-portable;

said mast being hollow and hacing a latch and release mechanism internal thereto located at the junction of said mast and said foundation;

a keyed messenger being configured to slide inside said hollow mast and to exert an inward and horizontal force upon said latch and release mechanism, said latch and release mechanism being responsive to the inward horizontal force of said keyed messenger to be activated when said keyed messenger is lowered down said hollow mast from the surface of the ocean to engage said latch and release mechanism.

2. The support structure of claim 1 further comprising a guide mechanism which permits easy re-installation of said mast by automatically aligning said mast and said foundation and decoupling said mast from boat motion and wave action.

3. The support structure of claim 1 wherein said foundation includes a piling and anchor assembly that can be water jetted into an ocean bottom comprised of soil or the like.

4. The support structure of claim 1 wherein said foundation includes a piling and hollow drill bit that can drill into an ocean bottom comprised of coral.

5. The support structure of claim 1 wherein said mast has attached external thereto a submerged instrument housing that can be accessed only when said mast is detached from said foundation.

6. The support structure of claim 1 further includes a breakaway flexible joint which provides a safely release protecting said mast from overload conditions.

7. The support structure of claim 2 wherein said guide mechanism includes:

a guide pole adapted to be temporarily attached to said foundation, a capture cone being affixed to the bottom end of said guide pole, said foundation having a stinger affixed thereto and being positioned parallel to said mast for receiving said capture cone, permitting said guide pole to slide over said stinger into the required position, rotational alignment means, a slide member engaging the top of said guide pole and being secured in that position by a releasable supporting means and being adapted to support said mast when being re-attached to said foundation and when released to slide down said guide pole guiding said masts in response to said rotational alignment means into position to be coupled to said foundation.

* * * * *